United States Patent [19]

Thomas et al.

[11] 4,058,319

[45] Nov. 15, 1977

[54] MULTI-PLAYER BACKGAMMON

[76] Inventors: Robert Melvin Thomas, 42 E. Edsall Blvd., Palisades Park, N.J. 07650; Robert Edward Thomas, 222 Lakeside Drive, Hopatcong, N.J. 07843

[21] Appl. No.: 685,588

[22] Filed: May 12, 1976

[51] Int. Cl.[2] ..... A63F 3/00

[52] U.S. Cl. ..... 273/134 AD; 273/134 G; 273/134 D; 273/136 R

[58] Field of Search ..... 273/134, 136

[56] References Cited

U.S. PATENT DOCUMENTS

| | | | |
|---|---|---|---|
| 2,133,515 | 10/1938 | Horton | 273/131 K |
| D. 85,066 | 9/1931 | Sternau | 273/134 G X |

FOREIGN PATENT DOCUMENTS

| | | | |
|---|---|---|---|
| 401,042 | 7/1909 | France | 273/134 G |

*Primary Examiner*—Delbert B. Lowe

*Attorney, Agent, or Firm*—Lawrence Rosen; E. Janet Berry

[57] ABSTRACT

Backgammon game board for the simultaneous play of four players. The game board is divided by transverse and longitudinal line to provide eight boards, each board including six points, said boards being symmetrically disposed about a central playing area. The central playing area contains selectively eight, 10 or 12 playing points through which each player must move his playing pieces from his two outer boards to his two inner boards. The eight boards contain 48 playing points which may be color coded in a manner corresponding to the color coding of the playing pieces so as to identify the flow of each player's playing pieces.

16 Claims, 6 Drawing Figures

MULTI-PLAYER BACKGAMMON

BACKGROUND OF THE INVENTION

The invention is in the field of amusement devices.

PRIOR ART

The game of backgammon has been played for centuries by two players, using a playing board of 24 points over which each player moves 15 counters, or men. The movement of one player's counters is in counter-flow direction to the movement of his opponent's counters, thus affecting and blocking the movements by his opponent. Because the moves of the men are determined by the throw of two dice, strategy in the game, and much of its appeal, are based upon ability to determine odds and to adjust play accordingly. Heretofore, backgammon normally has been restricted to two players. An adaptation known as chouette as played by three or more players recognizes the social value of enlarging the play to include more than two players. In chouette, however, each of the players are not of equal status, since one player plays against the combined strategy of the remaining players who act as a team with one of them selected as captain to make the final decision and moves.

Attempts have been made to incorporate some of the principals of backgammon into a four-player game. Parcheesi TM is a well-known example. While it is promoted as a backgammon game of India, it is almost entirely a game of chance and bears little resemblance to backgammon.

SUMMARY OF THE INVENTION

The present invention may be summarized as a method of utilizing a new variation of the backgammon game board and method of play which allows four players, individually or in partnerships of two, to oppose each other under standard backgammon procedures of play with each of the players being equal in play and decision making. The principal advance of the invention is the incorporation of a common battlefield playing board hereinafter referred to as the battlefield, through which each player must pass before entering his outer and inner "backgammon" boards. This common battlefield contains between six and 12 playing points depending upon the game variant chosen by the players. The battlefield for partnership play is so laid out that one partnership's men move in unison through the battlefield in opposition to the flow of their opponents' men. Outside of the battlefield area, each of the partners opposes one of the opponents on standard two-player backgammon playing boards. The invention transfers the standard methodology of backgammon play into a game for four players in which each player is equal in play and decision making.

One objective of the invention is to expand the standard play and conventions of a backgammon game, while still maintaining its rules and strategic advantages, into a game involving more than two players in which game the play of each player affects the play of every other player.

Another important objective is to allow new forms of strategy, in conjunction with standard probability strategies, to be employed by either a partnership or individuals acting in conjunction to oppose the movement of one opponent simultaneously.

Another objective of the invention is to utilize an expanded backgammon playing board in which the additional playing area utilizes the standard rules and forms of backgammon play.

Another objective of the game is to retain the strategic leeway used in standard backgammon for determining the value of the game in play, as that game continues in play.

A further objective of the game is to cause each individual of a partnership to play in a manner which will support his partner's play against the opponents and will not adversely hinder his partner's play.

It is an important objective of the invention to provide a game board for four players which, by the choice of the players, can be used for partnership or individual play involving movement of each player's men in the same playing area used by each of the other players.

DESCRIPTION OF THE INVENTION

To achieve the aforestated objectives, and such further objectives as may appear herein or be hereinafter pointed out, reference is made to the accompanying drawings, forming a part hereof, in which.

Figure 1:
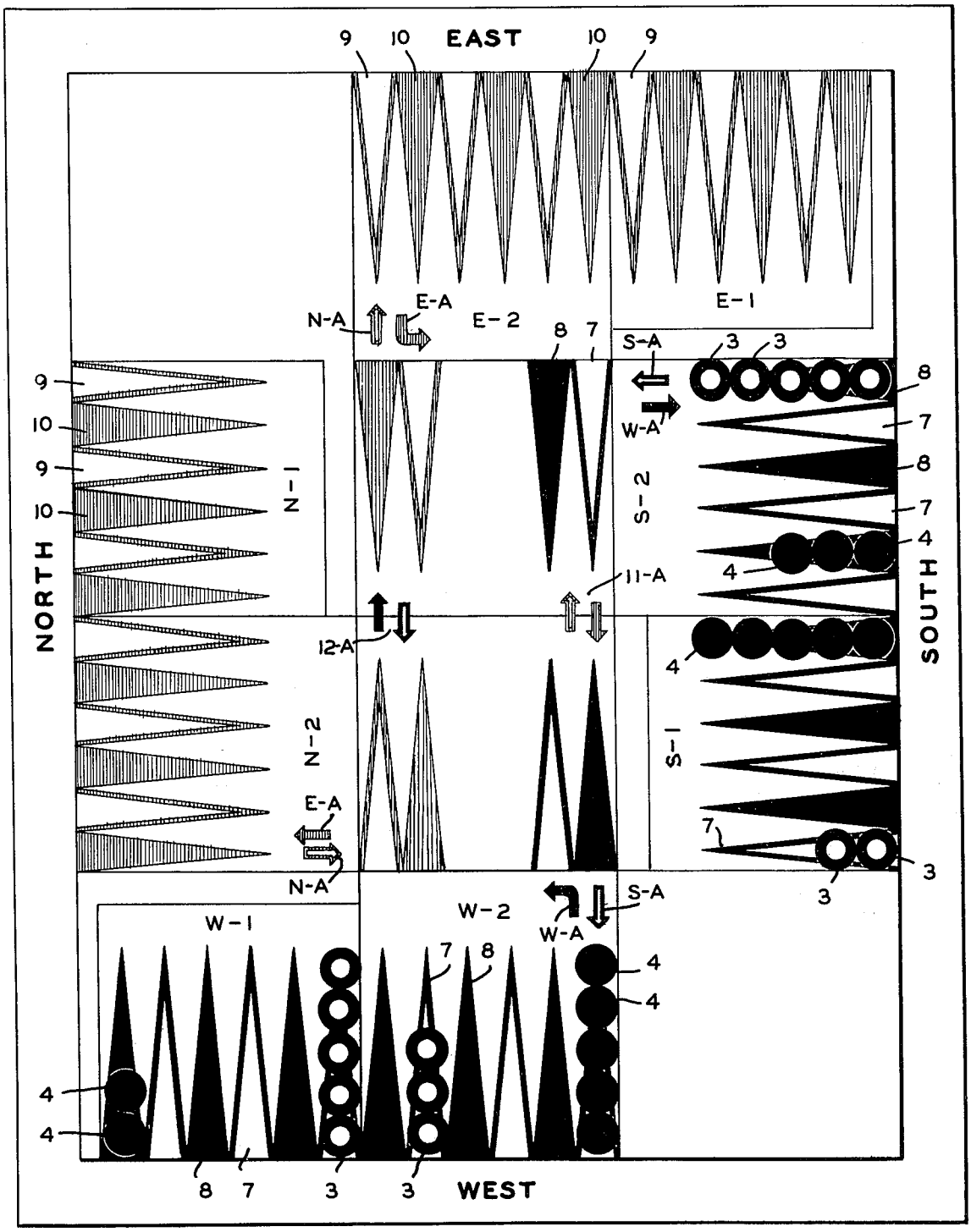
FIG. 1 is a plan view of the multi-player backgammon game board.

It will be readily seen by reference to FIG. 1 that the game board permits the achievement of the objectives of multiplayer backgammon. For convenience and purposes of the game description, the positions of the players are designated North (N), East (E), South (S) and West (W) with north and south being partners. Play by each player in turn in the game may be either clockwise or counter-clockwise, although the clockwise direction is preferred. Each player moves his counters through the standard backgammon playing field of four boards which are separated into two playing areas of two boards each by the common battlefield board traversed by each player. As in two-player backgammon, each player has an outer board and an inner board, or a home board, as it is sometimes designated, identified by number in FIG. 1 as follows:

Board S-1 is West's inner board.
Board S-2 is West's outer board.
Board W-1 is South's inner board.
Board W-2 is South's outer board.
Board N-1 is East's inner board.
Board N-2 is East's outer board.
Board E-1 is North's inner board.
Board E-2 is North's outer board.

The play of the men for each player is as follows:

South's men flow from board S-1 through board S-2, the battlefield, and boards W-2 and W-1.

East's men flow from board E-1 through board E-2, the battlefield, and boards N-2 and N-1.

North's men flow from board N-1 through board N-2, the battlefield, and boards E-2 and E-1.

West's men flow from board W-1 through board W-2, the battlefield, and boards S-2 and S-1.

The preceding flow pattern utilizes the central playing board containing eight points as in FIG. 1. To the central playing board of FIG. 1 two or four additional playing points (not shown) can be added to give a central playing area containing 10 or 12 points. By directional flow-control of the counters in the battlefield, it is thus possible to establish game patterns by which the players each traverse 7, 8, 9, 10, 11, or 12 points in their flow through the battlefield.

Figure 4:
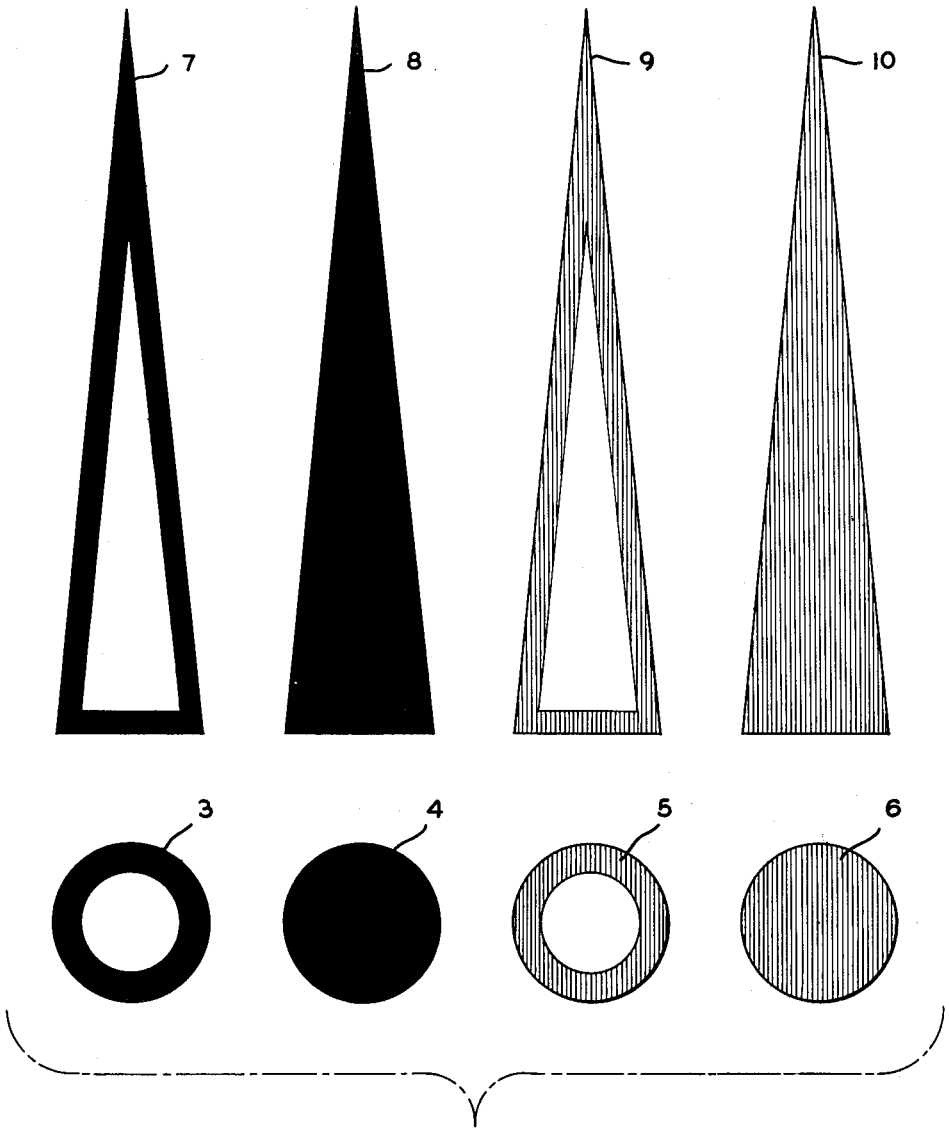
FIG. 4 is a plan view of an identifying coding designation of the points and men, or counters, which in conjunction with FIGS. 1, 2 and 3 readily demonstrates the placement and movement of each player's men.

FIG. 4 shows the coding used to identify and facilitate the flow of the men of each player through his playing boards. The counters and the points used to direct the flow of the counters for each player are identified as 3 and 7 for South, 5 and 9 for North, 6 and 10 for East, and 4 and 8 for West. Referring to this coding, the placement of counters at the beginning of the game is shown in FIG. 1 using as an example the counters of South and West on boards S-1, S-2, W-1 and W-2. The counters of North and East are positioned in like manner. Also shown by this example is the use of South and West as opponents on boards S-1, S-2, W-1 and W-2 as in standard two-player backgammon.

As in two-player backgammon, each board has six playing points. They are illustrated for convenience in FIG. 1 as triangles, or points, which have found common acceptance in backgammon. Other geometrical designs or configurations, such as rectangles or lines topped by coded circles, may be used. It is important, however, that the design used be identified, by color coding or other means, in such manner as to correspond to the same codings used to identify the men of the various players so as to facilitate the flow of each player's counters through his playing boards. As in backgammon, the alternate points are coded differently to facilitate counting of the points. An additional objective in multi-player backgammon is to use the alternate coding to identify the player's men who will pass through a given board. This coding speeds the play and facilitates the strategic play by making readily apparent the positions of the player's men as they are proceeding through their boards and the battlefield in opposition to their opponents.

It is readily obvious that a simple coding using four different colors can be used, with two colors appearing on any one board and all four colors appearing on the battlefield. Another variation is the use of two colors with white in which the men would be coded, for example, black, black-white, red and red-white. In this example, the triangle points would also be coded black, black-white, red and red-white. For convenience and ease of identification, the starting point of each player is coded with the identification code used for his men. This is shown in FIG. 1 in which the starting point in board S-1 holding two of South's men at the beginning of the game is coded black-white to correspond with his use of the black-white counters. The alternate points proceeding through boards S-1, S-2, W-2, and W-1 are also coded black-white. West's starting point on board W-1 is coded black in accord with his use of the black counters; the alternate points proceeding through boards W-1, W-2, S-2, and S-1 are also coded black. FIG. 4 in conjunction with the identifying numbers in FIG. 1 illustrates a typical coding for the men and points used in this example. Variations will be apparent to one skilled in the art and their use comes within the scope of our invention.

THE BATTLEFIELD

Figure 2:
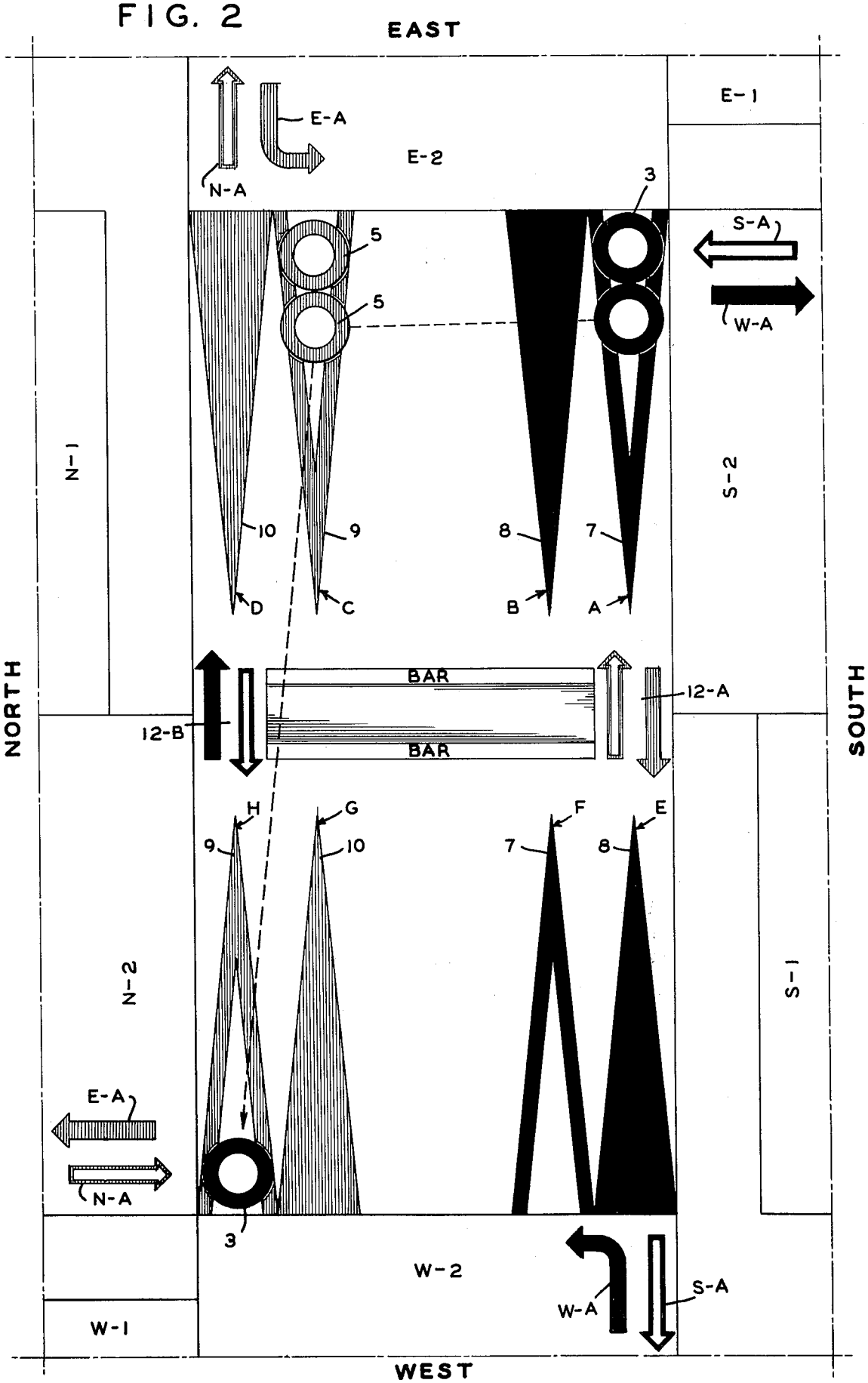
FIG. 2 is a plan view of the central playing board containing eight points showing partnership movement of men through it.

FIG. 2 is a plan view of the battlefield with directional arrows guiding the flow of men through the battlefield and with coded points at the entry point to the battlefield corresponding to the coded counter entering at that point. While these features are not essential to the invention, they do facilitate the speed of play and the visualization of the strategic positions of the various counters at any given moment of play. Directional arrows for entry to and exit from the battlefield are S-A, W-A, N-A, and E-A. Directional arrows to guide the counters through the battlefield are 12-B and 12-A. A bar such as that which is typically used in backgammon to hold men that have been knocked off from the playing board is shown in FIG. 2. However its presence is not essential to the invention or the play of the game. For convenience, bars may be placed between boards S-1, N-1 and the battlefield and between boards N-2 and W-1 and boards S-2 and E-1, FIG. 1. The bars are optional aid to the play.

The play of the various counters through the battlefield is as follows:

South's men flow across points A, B, C, D, H, G, F, and E to W-2.

East's men flow across points D, C, B, A, E, F, G, and H to N-2.

North's men flow across points H, G, F, E, A, B, C, and D to E-2.

West's men flow across points E, F, G, H, D, C, B, and A to S-2.

It is to be noted that the counters of the partnerships flow in the same direction and counter to the flow of the opponents, thus retaining the normal flow pattern of backgammon.

A variant in the freedom of movement of the counters from that of backgammon is used in the battlefield to enhance the mutual play of partners. This is illustrated in FIG. 2 using, as an example, the prior position of two of South's men 3 on point A and two of North's men 5 on point C prior to South's roll of the dice. With the roll of a double two, South may move both of his men 3 to point H. He cannot, however, move either of his men 3 to point C and leave it there. A partner may only temporarily occupy a point occupied by the counter of his partner, and his temporary use of the point does not affect the position of his partner's counters.

BATTLEFIELD VARIANT

The number of points in the battlefield may be expanded to 10 or 12; more than 12 points creates an undesirable extension in the playing time of the game. Also, a simple change in the direction of flow of the counters suffices to change the number of points passed through by each player and at the same time to reduce the number of points played in common by partners to less than the number of points on which each one encounters the opponents.

Referring to the eight-point battlefield of FIG. 2, a directional flow change will reduce the common partnership's points to four and each partner's common points against his prime opponent to six. This variation has an advantage when a faster game is desired in terms of finishing time. The change is accomplished by South opposing East as his prime opponent and North opposing West as his prime opponent. The flow of the players' counters then is as follows:

South's men flow over points A, E, F, G, H, and D and onto board E-2.

East's men flow over points D, H, G, F, E, and A and onto board S-2.

North's men flow over points H, D, C, B, A, and E and onto board W-2.

West's men flow over points E, A, B, C, D, and H and onto board N-2.

The use of simple overlays for the guide arrows in FIG. 2 will help to facilitate the movements of the counters.

Figure 3:
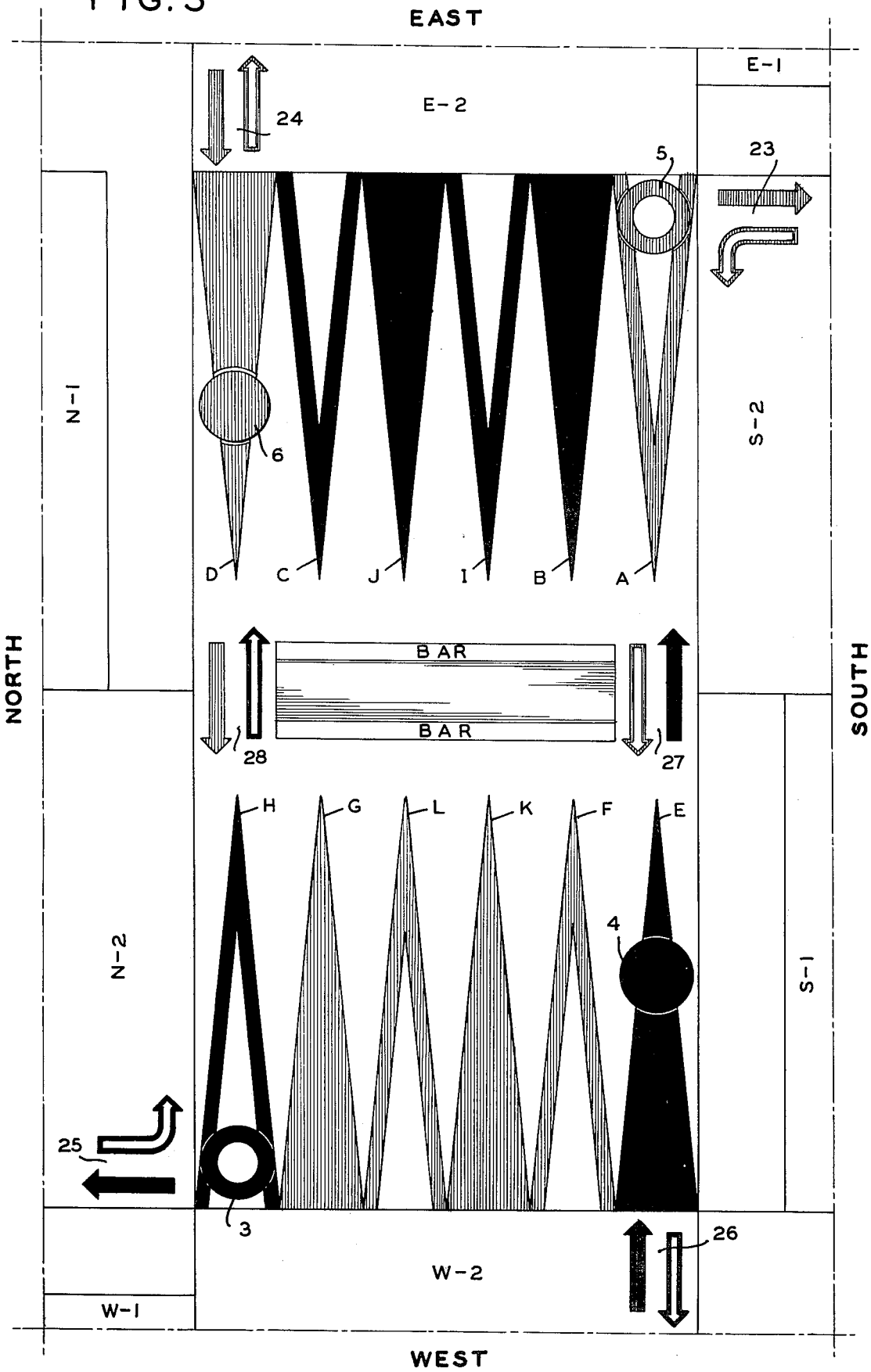
FIG. 3 is a plan view of a variation of the central playing board which by controlled directional flow of the player's men furnishes a common playing field of eight or 12 points.

This alternate-flow variation is also shown in FIG. 3 which illustrates the use of 12 points in the battlefield. All counters move clockwise in the battlefield. Each partner will pass against his prime opponent through eight points. He will encounter points used by his partner and his other opponent four times. The flow of the men in FIG. 3 is as follows:

South's men flow over points A, E, F, K, L, G, H, and D.

East's men flow over points D, H, G, L, K, F, E, and A.

North's men flow over points H, D, C, J, I, B, A, and E.

West's men flow over points E, A, B, I, J, C, D, and H.

This provides for a faster game than that provided for in FIG. 1.

By keeping the counterflow pattern of opponent's counters as set forth in FIGS. 1 and 2, each of the players will pass through all of the twelve points of the battlefield of FIG. 3.

BATTLEFIELD VARIANT FOR INDIVIDUAL PLAY

Figure 5:
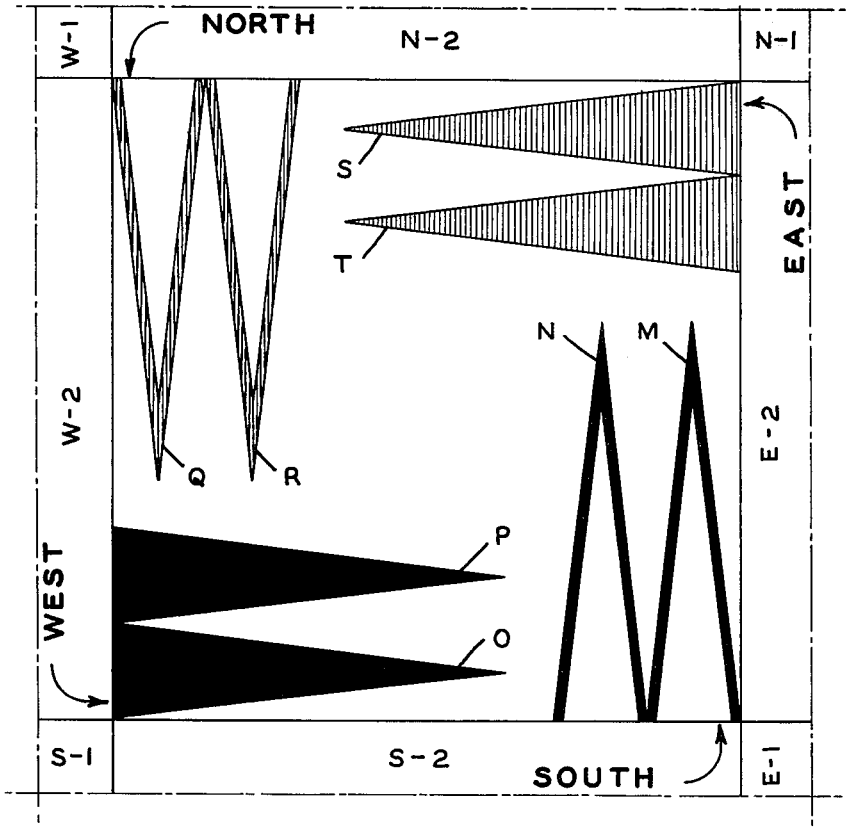
FIG. 5 is a plan view of a variation of the central playing board.

Variants other than those shown in FIGS. 1, 2 and 3 can be used to furnish a common playing field without departing from the scope of the invention. Such a variant is shown in the plan view of FIG. 5. The battlefield design of FIG. 5 is particularly suited for individual play by four people, although it can also be used for partnership play. The type of game, whether it is partnership or individual, is determined by the directional flow of the player's counters agreed to by the players prior to the start of the game. In individual play, all players move their counters in the same direction after leaving an outer board in either a clockwise or a counterclockwise direction. In partnership play, the counters of the partnership are moved in the same flow direction but counter to the flow of the counters of the opponents. Both types of play result in the use by each player of seven of the eight points in the battlefield. Examples of the paths of flow for each type of game follow:

Partnership Play (opposing flow)

South's men: M-T-S-R-Q-P and O, and off to board W-2.

West's men: O-P-Q-R-S-T and M, and off to board S-2.

East's men: S-T-M-N-O-P and Q, and off to board N-2.

North's men: Q-P-O-N-M-T and S, and off to board E-2.

Individual Play (same flow)

South's men: M-N-O-P-Q-R and S, and off to board E-2.

West's men: O-P-Q-R-S-T and M, and off to board S-2.

East's men: S-T-M-N-O-P and Q, and off to board N-2.

North's men: Q-R-S-T-M-N and O, and off to board W-2.

It is obvious that the flow pattern for the individual play can also be used for partnership play. The loss of the advantages of opposing flow of opponents' counters is offset by the resulting play of each partner through two of his boards against one opponent and through his other two boards against the other opponent.

Figure 6:
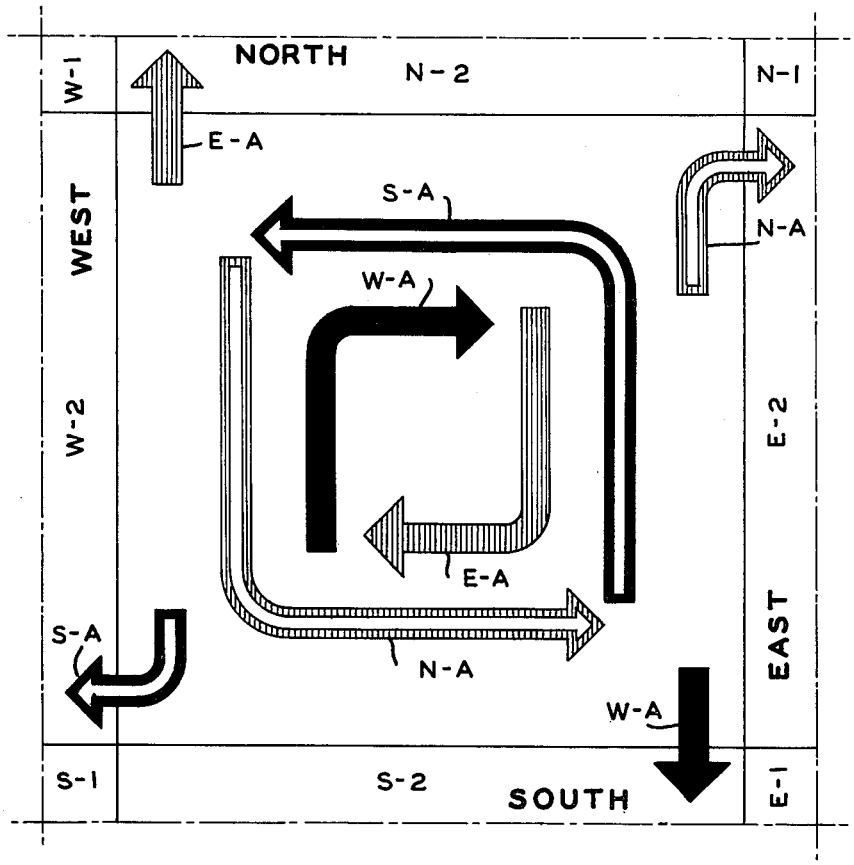
FIG. 6 is a plan view of a type of directional aid that may be employed to facilitate the movement of the counters through the central playing area.

Directional arrows may be included in the battlefield area to facilitate the flow directions of the counters. FIG. 6 shows an example of one such type of directional aid for movement of the counters through the battlefield. The arrows could be inserted within the center of FIG. 5. The design of FIG. 6 is so constructed that in play with an opposing flow of counters the partnerships follow the color code of arrows matching the color code of their counters. In individual play, or the alternate method of partnership play, all players follow the inner, solid color arrows. Other means of directional aid will be apparent to those skilled in the art and may be used within the scope of the invention.

SUGGESTED RULES OF PLAY

From the foregoing description, it will be evident that partnership backgammon and its other variants may be effected with a minimum of modification of the conventional rules of two-player backgammon. As in backgammon, the object of the game is for the players to pass each of their counters to their inner board and to remove each of their counters from the inner board before the opponents have done the same. Rules regarding the movement of men, the use of occupied points, the lifting off of opponent's men, re-entering the opponent's inner board, bearing off from a player's home board, and the use of the numbers obtained by throw of the dice follow the standard backgammon procedures as subscribed to by the International Backgammon Association, derived from those set down by the Backgammon and Cards Committee of the Racquet and Tennis Club of New York City in 1931.

With participation of more than two players, new variations become possible in scoring, doubling, co-use of points by partners, and continuing of play after one of the players has removed all of his counters from the game board. Rules governing the resultant possibilities are set forth to achieve the objectives of the invention.

PARTNERSHIP BACKGAMMON RULES

1. The game is played by four people, divided into opposing teams. Partners face each other across opposite sides of the board.

2. For the opening move, each player throws one die. The player with the highest number begins play by using the numbers thrown by himself and his partner. When the highest number is thrown by both partners, the partners select which player makes the first move. When the highest number is thrown by two opposing players, the highest partnership total determines the partnership making the first move. When the partnerships roll identical sets of dice, the value of the game is doubled, and the dice are recast to determine the first move.

3. After a player has borne off all 15 of his counters, he uses any remaining, unused die or complete turns to move the partner's counters not yet borne off.

4. In moving through the common board, or battlefield, a player may temporarily rest his man on a point occupied by one or more of his partner's men, but no man shall be allowed to rest on a point occupied by partner's men at the end of the completed play of the dice.

5. When both partners have borne off all counters, the game is won at the pre-set value agreed upon before play.

If both partners have borne off all men before one of the opponents has borne off any men, the value of the game is doubled.

If both partners have borne off all men before both of the opponents have born off any men, the value of the game is tripled, and If both partners have borne off all men before both opponents have borne off any men and while one or more of the opponent's men remains on the inner board of one of the winning partners or is awaiting entry to such board, the value of the game is quadrupled.

6. The value of the game may be doubled during the play of the game by only one player from each partnership, predesignated as the "doubler" for his team. The other doubling conventions of backgammon are retained.

INDIVIDUAL PLAY OF FOUR PLAYERS

1. The game is played by four persons, each opposing the other three players. Alliances may be made and broken during the game; an alliance is not binding upon subsequent play.

2. For the opening move, each player throws one die. Ties involving the highest number are rethrown by the players involved. The player with the highest number begins by rethrowing two dice.

3. Scoring Rules:

The player who first bears off all of his counters wins the game at the preset game value against each of the opponents in turn.

If an opponent has failed to bear off any men, the value of the game against that opponent is doubled.

If an opponent has failed to bear off any men and has one or more men in an opponent's inner board or awaiting re-entry into the inner board, the value of the game against that opponent is tripled.

4. The value of the game is not doubled when a die of the highest number is thrown at the start of the game.

5. The value of the game may be doubled during the play of the game by any player, but the player may not double again until each of the opponents still in play has doubled in turn. Each opponent may accept the double and remain in play or concede the double value of the game and withdraw from play. The counters of each player who withdraws from the game remain on the board and retain the same effect upon subsequent play as though the player were still playing. It is optional with the players whether or not the player whose double removes a man from the game has the right to land his counters on point(s) guarded by counters of the player not accepting the double.

What is claimed is:

1. A multi-player backgammon game board having the rectangular configuration of FIG. 1 of the drawings and having on its surface the eight board pattern and the central playing area shown in said FIG. 1.

2. The multi-player backgammon game board of claim 1 wherein the directional flow of the playing pieces of two players is counter to the directional flow of the playing pieces of at least one other player.

3. A multi-player backgammon game board having the rectangular configuration of FIG. 1 of the drawings and having on its surface the eight board game pattern of FIG. 1 with the central playing area configuration shown in FIG. 3 of the drawings.

4. A multi-player backgammon game board having the rectangular configuration of FIG. 1 of the drawings and having on its surface the eight board game pattern of FIG. 1 with the central playing area configuration shown in FIG. 5 of the drawings.

5. A multi-player backgammon game board for the play of four-player backgammon games, said game board consisting of 48 playing points evenly distributed in eight boards symmetrically disposed around a central playing area containing an even number of playing points ranging from eight to 12 playing points through which each player must move his playing pieces from two of the surrounding playing boards to the remaining two of his playing boards.

6. The multi-player backgammon game board of claim 5 wherein said central playing area consists of one playing board.

7. The multi-player backgammon game board of claim 5 wherein said central playing area consists of two playing boards.

8. The multi-player backgammon game board of claim 5 wherein said central playing area has the configuration shown in FIG. 2 of the drawings.

9. The multi-player backgammon game board of claim 5 wherein said central playing area has the configuration shown in FIG. 3 of the drawings.

10. The multi-player backgammon game board of claim 5 wherein said central playing area has the configuration shown in FIG. 5 of the drawings.

11. The multi-player backgammon game board of claim 5 having the alternate playing points of the 48 playing points in the eight boards surrounding a central playing area coded to correspond to the codes identifying the playing pieces of the players so as to identify the flow of each player's playing pieces through four of the eight playing boards surrounding the central playing area.

12. The multi-player backgammon game board of claim 11 in which the coding is by combinations of four different colors.

13. The multi-player backgammon game board of claim 11 in which the coding is by combination of two colors with white or another color to give the required four codings.

14. The multi-player backgammon game board in claim 11 having directional aids showing the directional flow of the playing pieces of each player from one of his playing boards through the central playing area and onto another of his playing boards.

15. The multi-player backgammon game board of claim 11 in which the coded paths for each player are so arranged as to cause each player to move his playing pieces through four of the playing boards which are traversed by the playing pieces of one of his opponents.

16. The multi-player backgammon game board of claim 11 in which the coded paths for each player are so arranged in combination with directional flow of his playing pieces through the central playing area so that each player moves his playing pieces through two of the eight playing boards which are traversed by the playing pieces of one opponent and through two other playing boards which are traversed by the playing pieces of another opponent.

* * * * *